US005678794A

United States Patent [19]

Kump

[11] Patent Number: 5,678,794

[45] Date of Patent: Oct. 21, 1997

[54] ADJUSTABLE LENGTH PEGBOARD SIGN HOLDER

[75] Inventor: Daniel J. Kump, Mentor, Ohio

[73] Assignee: Fasteners For Retail, Inc., Cleveland, Ohio

[21] Appl. No.: 421,311

[22] Filed: Apr. 13, 1995

[51] Int. Cl.[6] ..... A47B 96/06

[52] U.S. Cl. ..... 248/220.31; 248/298.1; 40/642; 211/59.1

[58] Field of Search ..... 248/220.22, 220.31, 248/222.51, 309.2, 286.1, 287.1, 298.1; 40/124, 124.1, 642; 211/57.1, 59.1, 22

[56] References Cited

U.S. PATENT DOCUMENTS

| | | | |
|---|---|---|---|
| D. 300,003 | 2/1989 | Hutchison | D20/43 |
| D. 307,448 | 4/1990 | Akard | D20/43 |
| D. 316,729 | 5/1991 | Crowley | D20/43 |
| 1,833,022 | 11/1931 | Judelson | 248/222.51 |
| 2,686,030 | 8/1954 | Johnson | 248/286.1 |
| 2,711,872 | 6/1955 | Lampke | 248/286.1 |
| 3,610,425 | 10/1971 | Madey | 211/57 |
| 3,931,919 | 1/1976 | Gerber | 211/22 |
| 4,104,817 | 8/1978 | Herzog | 40/19.5 |
| 4,286,764 | 9/1981 | Pfeifer | 248/220.3 |
| 4,394,909 | 7/1983 | Valiulis et al. | 211/59.1 |
| 4,667,914 | 5/1987 | Bailey | 248/286.1 |
| 4,860,905 | 8/1989 | Schott et al. | 211/59.1 |
| 5,082,215 | 1/1992 | Hutchison | 248/220.4 |
| 5,083,729 | 1/1992 | Saeks | 211/22 |
| 5,325,616 | 7/1994 | Valiulis | 40/229 |

OTHER PUBLICATIONS

Southern Imperial, Inc. 1994 Display Products Catalog (cover page and p. 100).

Fasteners For Retail 1994 Buyers Guide (cover page and p. 53).

Peg–Tag Company advertisement circa 1990 showing Peg–Tags Multi–Purpose Sign Holders for 1/4" Pegboard.

*Primary Examiner*—Leslie A. Braun
*Assistant Examiner*—Gwendolyn Wrenn Baxter
*Attorney, Agent, or Firm*—Fay, Sharpe, Beall, Fagan, Minnich & McKee

[57] ABSTRACT

A variable length sign holder includes a base having a sleeve including a first end, a second end and a socket extending from the first end toward the second end, as well as a plate to which the second end of the sleeve is secured. A slot extends longitudinally along an exterior periphery of the sleeve and communicates with the socket. A pair of enlarged openings are located on the sleeve exterior periphery. The pair of openings are longitudinally spaced along the slot. A support member cooperates with the base. The support member includes a shaft which is slidably mounted in the socket of the base sleeve. The shaft has a first end, a second end and an outer periphery on which is located a lug. The lug cooperates with one of the pair of enlarged openings located on the sleeve exterior periphery.

20 Claims, 5 Drawing Sheets

ADJUSTABLE LENGTH PEGBOARD SIGN HOLDER

BACKGROUND OF THE INVENTION

This invention relates generally to displays. More particularly, the present invention relates to a point of purchase display which provides information concerning a package or item hanging adjacent the display.

Pegboard display systems have long been popular with retail merchants for displaying merchandise for selection by customers. Such pegboard display systems typically use a generally upright merchandise display panel, such as a pegboard, to which product support devices can be secured. The pegboard support has a matrix of uniformly spaced holes that can receive product support devices such as display hooks or brackets. These display hooks have a mounting base including one or more hook shaped prongs which extend rearwardly of the mounting base and which engage selected mounting holes in the matrix of holes formed in the pegboard support. When mounted at desired positions on the display surface, the display hooks project forwardly thereof to hold merchandise. The pegboard support provides a vertically oriented mounting surface and forms the background for the product display.

A wide variety of retail displays have been proposed which use product support brackets or display hooks mounted in panels such as pegboards. The merchandise displayed on each of these display hooks needs to have its price identified. This is generally done by sign holders. Although a variety of differing sign holders and methods of attachment of those sign holders to a support panel adjacent a display hook can be employed, there are two types of sign holders which are the most widespread. In a first type, a separate display hook is employed. The display hook has a mounting base and a support arm connected to the mounting base and extending forwardly of the front surface of the support panel.

In this type of retail display, a separate sign holder is employed. The sign holder has a mounting base, a display arm and an information display plate. The mounting base can be a plate which is thin enough to permit it to be interposed between the pegboard and the base of the display hook. The plate is also provided with engagement means for engaging the prongs of the display hook to prevent the sign holder from sliding down in relation to the display hook. In another design, the sign holder has a mounting base with a prong which can be secured in an aperture of the support panel adjacent the location of the display hook. However, with different lengths of display hooks, different lengths of such conventional sign holders are also necessary. Generally, the display hooks can range from 10 to 14 inches. Therefore, a variety of sign holder lengths is necessary, one for each length of display hook. This is disadvantageous from the standpoint of the merchant who needs to replace the sign holder used every time a different length display hook is employed.

Another display hook and information display panel system includes a unitary arrangement in which the sign holder is integral with the display hook such that both elements are manufactured from a common plastic piece. Obviously with a unitary arrangement, there is no problem in matching the length of the sign holder to the length of the display hook.

Recently, an adjustable length sign holder has been developed. This sign holder employs a plastic mounting base having a through socket in which a metal display arm may slide to adjust the length of the sign holder. However, this type of information display bracket demands that there be room behind the pegboard to accommodate whatever length of display arm extends through the pegboard. In addition, with this sign holder, there is no means provided to securely lock the display arm in the mounting base to prevent a sliding movement thereof.

Also known is an adjustable length guard assembly for a pegboard hook wherein the flexible guard is adapted to overlie the arm of the hook and a shield of the guard substantially encloses the outer end of the hook. The guard is formed by two slidable telescoping sections. The effective length of the guard can be changed to enable the guard to be used with hanger arms of different lengths. However, this known guard does not have a tip which can successfully function as a sign holder. Moreover, this known design is rather complex and, therefore, expensive to manufacture. It also uses a substantial amount of plastic material as it is planar and has a pair of fingers that need to be accommodated in a pair of pegboard holes.

Accordingly, it has been considered desirable to develop a new and improved adjustable length pegboard sign holder which would overcome the foregoing difficulties and others while providing better and more advantageous overall results.

BRIEF SUMMARY OF THE INVENTION

According to the present invention, a variable length sign holder is provided.

More particularly, the sign holder comprises a base comprising a sleeve including a first end, a second end and a socket extending from the first end toward the second end and a plate to which the second end of the sleeve is secured. A slot extends longitudinally along an exterior periphery of the sleeve and communicates with the socket. A pair of enlarged openings are located on the sleeve exterior periphery with the pair of openings being longitudinally spaced along the slot. A support member cooperates with the base. The support member comprises a shaft slidably mounted in the socket of the base sleeve. The shaft has a first end, a second end and an outer periphery on which is located a lug which cooperates with one of the openings.

Preferably, the base further comprises a stub extending away from the plate. The stub and the sleeve preferably extend from opposed faces of the plate. If desired, the base is of one piece and is comprised of a plastic material. Preferably the support member shaft further comprises a relieved area aligned with the lug and spaced therefrom. The support member preferably further comprises a face channel located on the second end of the shaft. Preferably the support member is of one piece and is comprised of a plastic material. If desired, the support member shaft can comprise a pair of spaced lugs and a relieved area aligned with a respective one of the pair of lugs and spaced therefrom.

According to another aspect of the present invention, a variable length sign holder is provided.

More particularly in accordance with this aspect of the invention, the sign holder comprises a base having a sleeve including a first end, a second end and a socket extending from the first end toward the second end. The second end of the sleeve is secured to a plate. A support member comprises a shaft slidably mounted in the socket of the base sleeve, the shaft having a first end, a second end and an outer periphery. A flexing means is provided for allowing the sleeve to expand and accommodate a sliding movement of the shaft in the sleeve. The flexing means is located on the sleeve. A locking means is provided for securing the shaft at a predetermined location along the length of the sleeve. The locking means is located on at least one of the base and the support member.

Preferably the base further comprises a stub extending away from the plate and wherein the stub and the sleeve extend in opposed directions from the plate. Preferably the locking means comprises a pair of enlarged openings located on the sleeve exterior periphery with a pair of openings being longitudinally spaced along the sleeve and a lug located on the shaft outer periphery with the lug cooperating with one of the openings. The sign holder can, if desired, further comprise a biasing means for urging the lug outwardly of the shaft. The support member shaft can comprise a resilient material with the biasing means comprising a relieved area located in the shaft, the relieved area being aligned with the lug and being spaced therefrom. Preferably the flexing means comprises a slot extending longitudinally along an exterior periphery of the sleeve and communicating with the socket.

One advantage of the present invention is the provision of a new and improved sign holder.

Another advantage of the present invention is the provision of an adjustable length sign holder for pegboards of the type formed with a series of vertically spaced and horizontally extending rows of holes. The sign holder can be adjusted in length for use in conjunction with any of a variety of lengths of conventional pegboard display hooks having a generally horizontal hanger arm for supporting one or more articles from a pegboard.

Yet another advantage of the present invention is the provision of a two piece adjustable length sign holder having a base with a sleeve including a flexing means for accommodating a longitudinal sliding movement of a shaft of a support member in the sleeve.

A further advantage of the present invention is the provision of a two piece adjustable length sign holder having a locking means for securing a shaft of a support member at predetermined locations along the length of a sleeve of a base. When desired, the shaft can be slid in the sleeve to another predetermined location on the base and locked at that location also.

A still further advantage of the present invention is the provision of an adjustable length two piece sign holder having a base and a support member. A biasing means of the support member urges a lug of a locking means outwardly of a shaft of the support member and into engagement with the walls of an opening provided in a sleeve of the base of the sign holder.

A yet further advantage of the present invention is the provision of an adjustable length two piece sign holder having a base which can be provided with a plurality of different mounting stub configurations. Such configurations allow the base to be mounted to an adjacent pegboard in a secure manner.

A yet still further advantage of the present invention is the provision of an adjustable length two piece sign holder having a base with an integral living hinge. This construction allows a shaft mounted in a sleeve of a base to normally rest on a pegboard display hook located therebelow. When it is desired to remove a package from the display hook, the sleeve and shaft can be pivoted out of the way.

Still other benefits and advantages of the invention will become apparent to those skilled in the art upon a reading and understanding of the following detailed specification.

BRIEF DESCRIPTION OF THE DRAWINGS

The invention may take form in certain structures and components, preferred embodiments of which will be described in detail in this specification and illustrated in the accompanying drawings which form a part hereof and wherein.

DETAILED DESCRIPTION OF THE PREFERRED EMBODIMENTS

Figure 2:
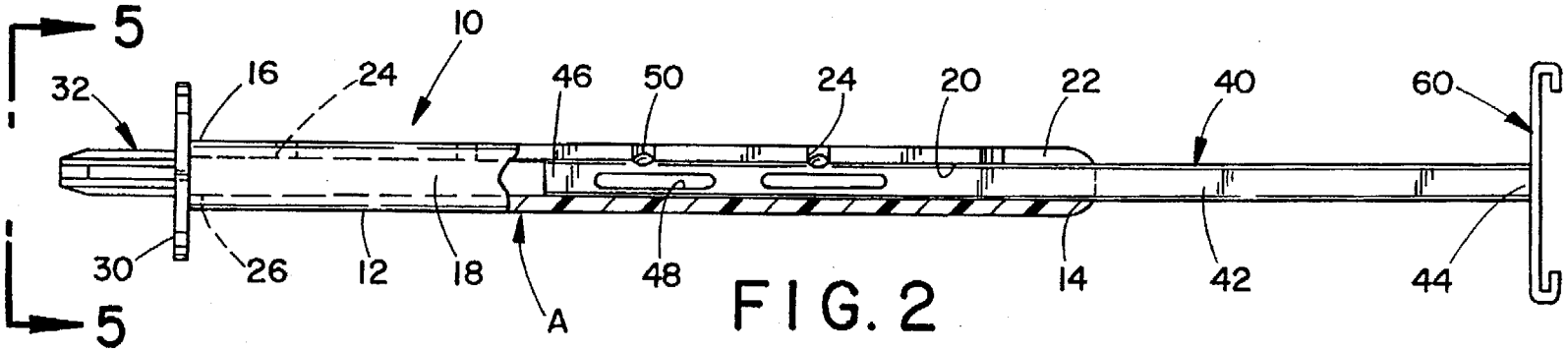
FIG. 2 is an assembled side elevational view of the sign holder of FIG. 1 in an upside down orientation.

Referring now to the drawings wherein the showings are for purposes of illustrating preferred embodiments of the invention only and not for purposes of limiting same, FIG. 2 shows a sign holder A according to the present invention. While the sign holder is primarily designed for, and will hereinafter be described in connection with a pegboard display, it should be appreciated by those of average skill in the art that the sign holder could also be utilized in other types of display environments.

Figure 1:
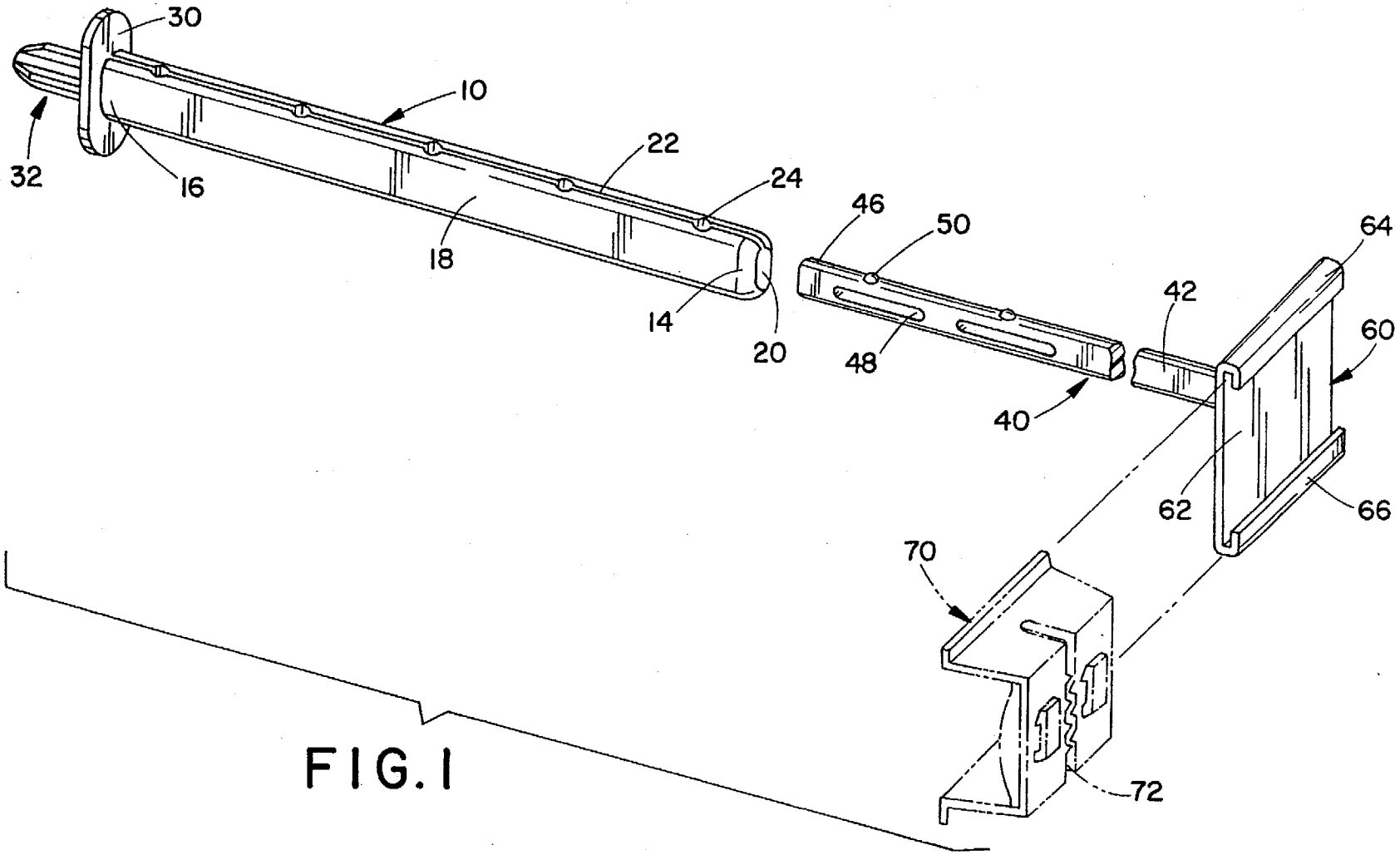
FIG. 1 is an exploded perspective view of the sign holder according to the present invention in an upside down orientation.

With reference now to FIG. 1, the sign holder comprises a base 10 including a sleeve 12 having a front end 14 and a rear end 16, as well as an exterior periphery 18. Extending longitudinally from the front end 14 towards the rear end 16 in the sleeve 12 is a socket 20. Provided for the sleeve 12 is a flexing means in the form of a slot 22 located in and extending longitudinally along the sleeve. The slot extends inwardly from the outer periphery 18 of the sleeve so as to communicate with the socket 20. If desired, the slot 22 can run from the front end 14 of the sleeve to its rear end 16. Longitudinally spaced along the slot 22 are a plurality of enlarged openings 24. Located at the rear end 16 of the sleeve 12 is a through bore 26 (FIG. 2) which communicates with the socket 20.

Figure 5:
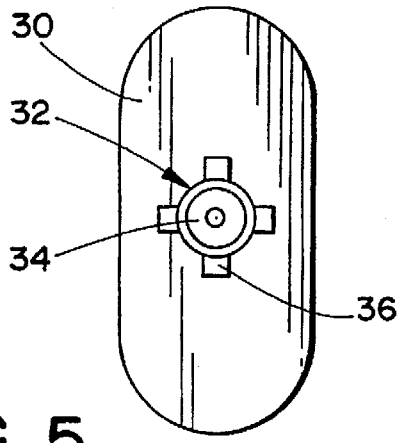
FIG. 5 is a rear end view of the sign holder of FIG. 2 along line 5—5.

The sleeve 12 is secured at its rear end 16 to a first face of a somewhat elliptical-shaped plate 30. It can be seen from FIG. 2 that the sleeve 12 and the stub 32 each extend in a direction substantially normal to a plane of the plate 30. With reference now to FIG. 5, the stub 32 comprises a longitudinally extending shaft 34 from which extend a plurality of radially outwardly directed spaced ribs 36. While four such ribs are illustrated in FIG. 5, it should be appreciated that any suitable number of ribs can be provided as may be needed. The ribs enable the stub to be secured in varying sizes of pegboard holes.

Adapted to cooperate with the base 10 is a tag support member 40, as illustrated in FIG. 1. The tag support member comprises a longitudinally extending shaft 42 which is so sized as to fit in the socket 20 of the sleeve 12. The shaft includes a first end 44 and a second or free end 46. Extending transversely through the shaft 42 are a pair of elongate spaced through holes 48. Aligned with each of the through holes 48 is a respective one of a pair of lugs 50. The lugs cooperate with the enlarged openings 24 of the sleeve 12 to provide a locking means for selectively locking the tag support member 40 in a desired longitudinal location in relation to the base 10, as shown in FIG. 2.

It is evident from FIG. 2 that preferably five spaced enlarged openings 24 are located on the sleeve 12 whereas there are only two lugs 50 on the shaft 42. Therefore, the overall length of the sign holder A can be varied by up to four positions of the enlarged openings while employing both lugs. If each of the enlarged openings 24 is spaced apart by one inch intervals, the overall length of the sign holder can be varied by up to 4 inches. For example, the sign holder A can have an overall length of 10 inches at its most collapsed position and 14 inches at its most extended position. This range of sign holder lengths accommodates the lengths of most conventional display hooks manufactured today.

Figure 4:
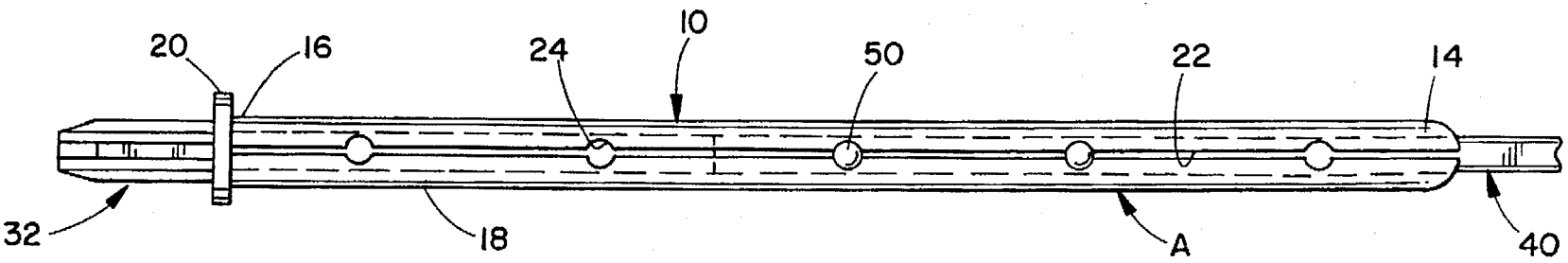
FIG. 4 is a bottom plan view of the sign holder of FIG. 3.
Figure 3:
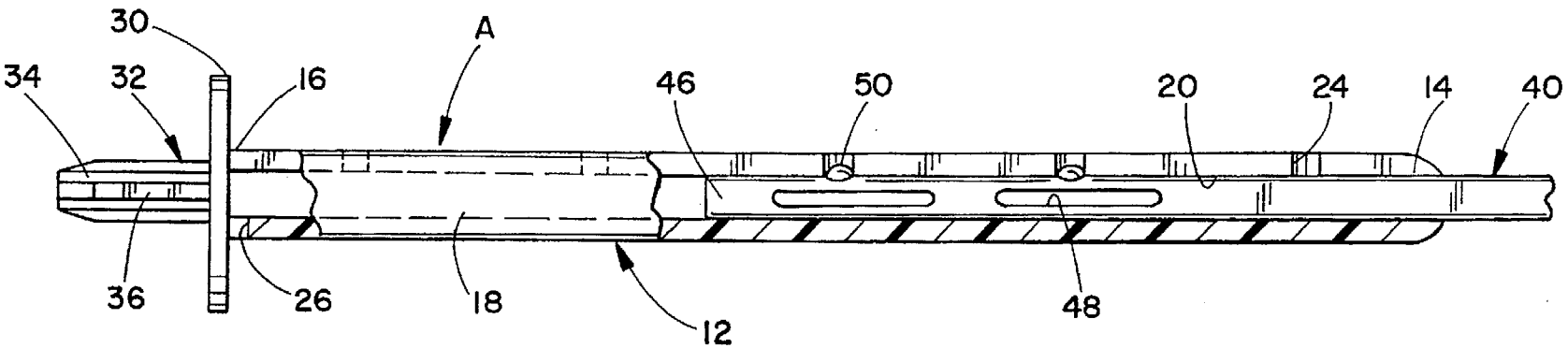
FIG. 3 is an enlarged side elevational view, partially broken away, of the sign holder of FIG. 2.

In order to prevent the shaft 42 from rotating in relation to the sleeve 12, both of these elements are elliptical in shape. This can be seen from the perspective view of FIG. 1 as well as a comparison of the side elevational view in FIG. 3 with the bottom plan view of FIG. 4.

Preferably, both the base 10 and the tag support member 40 are comprised of a suitable conventional resilient material, such as a plastic. The base 10 can be made of a suitable thermoplastic material, such as nylon. In contrast, the tag support member 40 is preferably made of a more rigid thermoplastic material, such as ABS (Acrylonitrile Butadiene Styrene). The shaft 42 of the tag support member 40 needs to be relatively rigid in order to support a sign in a substantially horizontal orientation to the viewer and in a substantially perpendicular orientation to the plane of a pegboard.

It should be evident that the base 10 and the tag support member 40 are each manufactured separately and later need to be joined in order to form the sign holder A. Because of manufacturing tolerances, it has been found necessary to employ the flexible sleeve 12 which is provided with the slot 22. The sleeve needs to be flexible in order to accommodate the slightly varying diameters of the shafts which are produced during the manufacturing process of the tag support members. The flexing of the sleeve also accommodates the slightly varying diameters of the sockets produced during the manufacturing process of the bases. For these reasons, the base 10 needs to be made of a material more flexible than ABS material of the tag support member. One suitable such material is nylon. The purpose for the bore 26 on the top surface of the sleeve 12 adjacent the plate 30 is to enhance the molding process for producing the base 10.

When the shaft 42 is comprised of a suitable resilient material, the elongate through holes 48 serve as biasing means for urging the lugs 50 outwardly into the enlarged openings 24 in the sleeve 12 when the lugs 50 are aligned with the openings. However, when the shaft 42 is moved longitudinally in relation to the sleeve, the elongate through holes allow the lugs 50 to flex inwardly thereby enabling an easier sliding movement of the shaft 42 in the socket 20. At the same time, the slot 22 of the sleeve enables the sleeve to open slightly and this also allows an easier sliding of the shaft 42 in the sleeve 12. While through openings 48 are illustrated herein, it should be appreciated that any relieved area in the material of the shaft 42 below the lugs 50 would serve equally well to provide the resilience necessary to allow the lugs to flex in and out along the periphery of the shaft 42.

Figure 7:
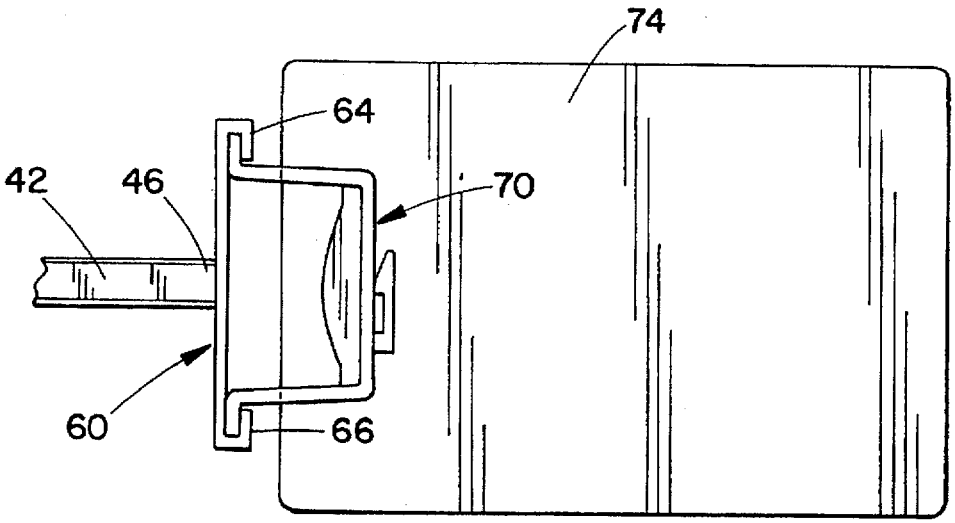
FIG. 7 is an enlarged side elevational view of a front end of the sign holder of FIG. 1 supporting an associated card holder and a sign.

As is illustrated in FIG. 1, provided at the second end 46 of the shaft 42 is a face channel 60 which is preferably integral with the shaft. The face channel comprises a back wall 62 and a pair of spaced forwardly protruding flanges 64 and 66. The flanges are sized to accommodate a conventional card holder 70. The holder has a vertically extending slot 72 for gripping a suitable tag or card 74, as illustrated in FIG. 7.

Figure 6:
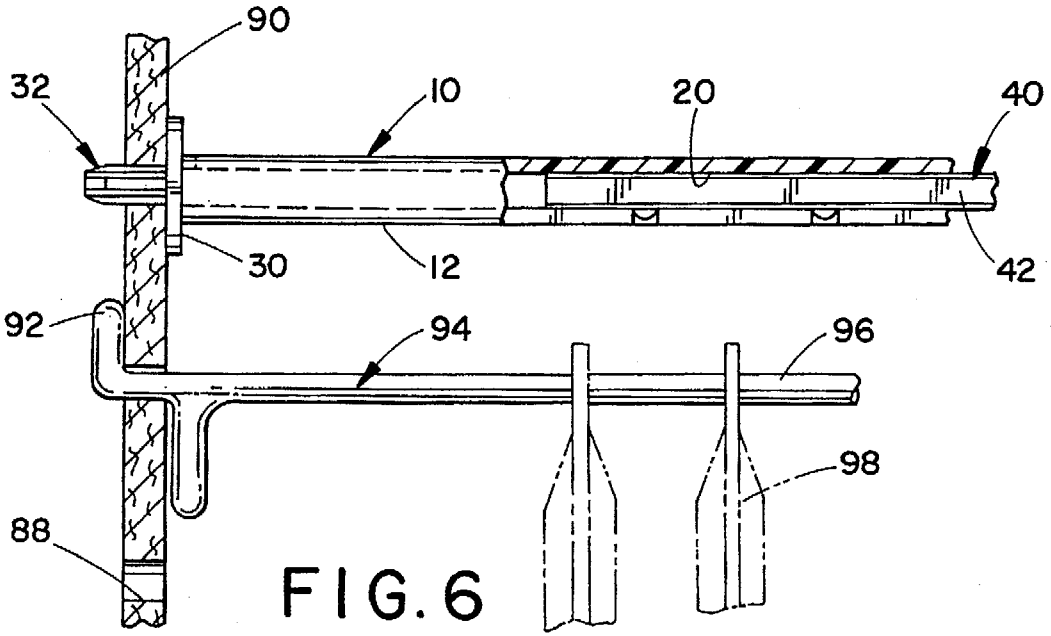
FIG. 6 is a side elevational view of a portion of the sign holder of FIG. 1 mounted on a pegboard above a conventional product display hook.

With reference now to FIG. 6, the stub 32 can be selectively accommodated in a suitable one of a plurality of holes 88 in a pegboard 90. The second face of the plate 30 contacts the front face of the pegboard 90 and serves as a stop to prevent further sliding of the sign holder in relation to the pegboard. The plate 30 also serves to cover the pegboard hole 88. The sign holder A is meant to be held in a pegboard hole directly above a hole which accommodates a prong 92 of a conventional display hook 94. The display hook 94 includes a longitudinally extending shaft 96 on which a plurality of packages 98 are supported. As mentioned, the length of the sign holder A can be adjusted in order to lock at, e.g., 1 inch increments from 10 inches to 14 inches. The length of the sign holder A can thus be adjusted to accommodate the various lengths of most conventional pegboard display hooks which are commercially available today.

Figure 8:
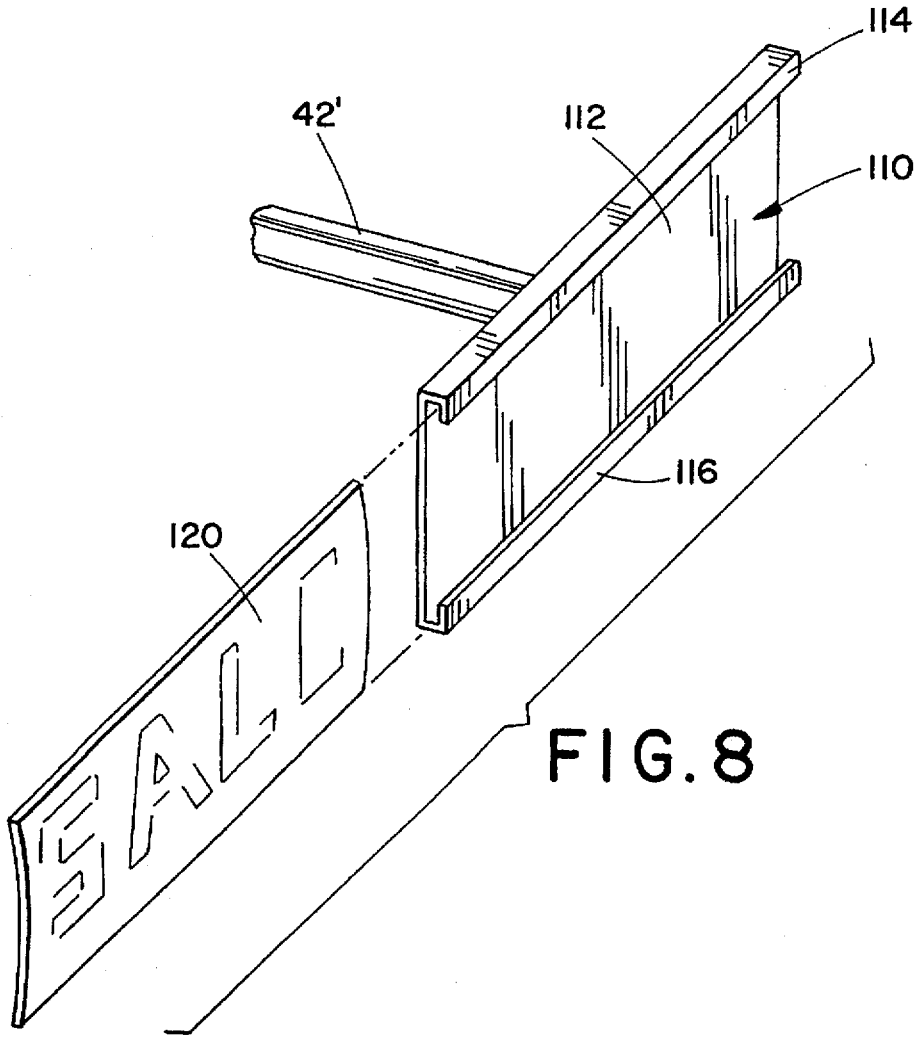
FIG. 8 is an enlarged exploded perspective view of a front end of another sign holder according to the present invention and a tag which can be mounted therein.

With reference now to FIG. 8, an alternative sign holder is there illustrated. For ease of comprehension and appreciation of this alternative, like components will be identified by like numerals with a primed suffix (') and new components will be identified by new numerals.

In this figure, a tag support member shaft 42' includes an elongated face channel 110 comprising a back wall 112 and a pair of spaced forwardly protruding flanges 114 and 116. The flanges are sized so as to accommodate a conventional elongated tag or sign 120. It should be appreciated that the face channel 110 is considerably wider than is the face channel 60 illustrated in FIG. 1. The reason for this is that the face channel 60 is only meant to accommodate the card holder 70 whereas the face channel 110 needs to support the elongated tag 120.

Figure 9:
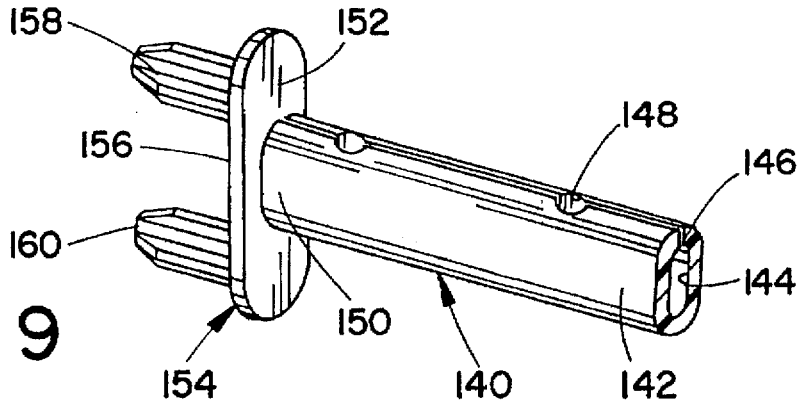
FIG. 9 is a perspective view of a rear section of a base according to another embodiment of the present invention.
Figure 10:
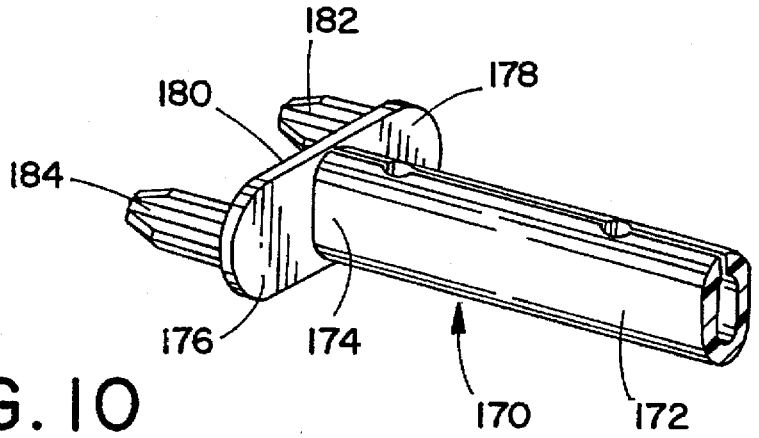
FIG. 10 is a perspective view of a rear portion of a base according to still another embodiment of the present invention; and, FIG. 11 is a side elevational view of a rear end of a base according to a yet further embodiment of the present invention.
Figure 11:
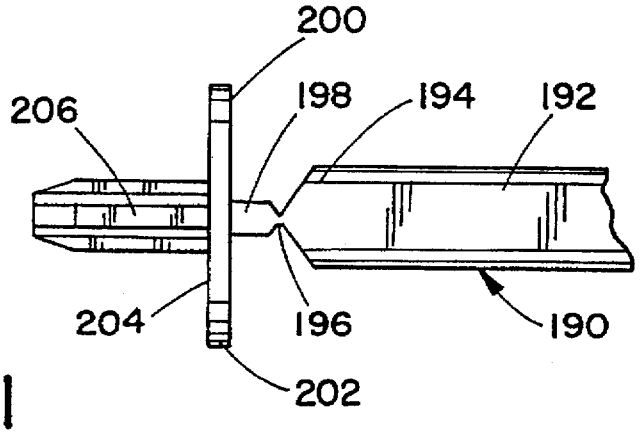

With reference now to FIGS. 9–11, several alternative base configurations are there illustrated. In each of these base configurations, a tag support member, such as the member 40 illustrated in FIG. 1, can be employed. With reference first to FIG. 9, a base 140 includes a sleeve 142 having a longitudinally extending socket 144. Extending inwardly from an outer periphery of the sleeve 142 so as to communicate with the socket 144 is a slot 146. Spaced along the length of the slot are a plurality of enlarged openings 148. A rear end 150 of the sleeve 142 is secured to a first face 152 of a plate 154. Located on a second side 156 of the plate are a pair of vertically spaced stubs 158 and 160. The stubs are spaced from each other by approximately 1 inch on center so that each of the stubs can fit in a respective one of a plurality of vertically spaced holes of a conventional pegboard. Two such vertically spaced stubs are advantageous for stiffening the base of the sign holder and eliminating a vertical swiveling motion thereof.

With reference now to FIG. 10, another type of base 170 according to the present invention includes a sleeve 172 which is secured at its rear end 174 to a first face 176 of a plate 178. Secured to a second face 180 of the plate are a pair of horizontally spaced stubs 182 and 184. The use of a pair of horizontally spaced stubs is advantageous for eliminating a horizontal swiveling of the sign holder. Such a base construction also centers the sign holder over the longitudinally extending shaft of a display hook if the display hook is of the type which has a pair of horizontally spaced prongs.

Referring now to FIG. 11, a pivotable sign holder construction is there illustrated. In this construction, a base 190 includes a sleeve 192 having a rear end 194 which tapers down to a living hinge 196. The hinge 196 leads to a stem 198. The stem 198 is fastened to a first face 200 of a plate 202. Extending from a second face 204 of the plate 202 is at least one stub 206. In this sign holder construction, the sleeve 192, and the shaft of the sign holder held therein, rests on the subjacent shaft of a display hook. The living hinge allows the sleeve 192 of the sign holder to pivot out of the way when it is desired to remove a package from the shaft of the display hook.

The invention has been described with reference to preferred embodiments. Obviously, modifications and alterations will occur to others upon the reading and understanding of this specification. It is intended to include all such modifications and alterations insofar as they come within the scope of the appended claims or the equivalents thereof.

What is claimed is:

1. A variable length sign holder comprising:

a base comprising:

a sleeve including a first end, a second end and a socket extending from said first end toward said second end, a plate to which said second end of said sleeve is secured, a slot extending longitudinally along an exterior periphery of said sleeve and communicating with said socket, and a pair of enlarged openings located on said sleeve exterior periphery, said pair of enlarged openings being longitudinally spaced along said slot; and, a support member comprising a shaft slidably mounted in said socket of said sleeve, said shaft having a first end, a second end and an outer periphery on which is located a lug which cooperates with one of said enlarged openings such that said lug is selectively accommodated in said one of said enlarged openings.

2. The variable length sign holder of claim 1 wherein said base further comprises a stub extending away from said plate.

3. The variable length sign holder of claim 2 wherein said stub and said sleeve extend from opposed faces of said plate.

4. The variable length sign holder of claim 2 wherein said base is of one piece and is comprised of a plastic material.

5. The variable length sign holder of claim 1 wherein said support member shaft further comprises a relieved area aligned with said lug and spaced therefrom.

6. The variable length sign holder of claim 1 wherein said support member further comprises a face channel located on said second end of said shaft.

7. The variable length sign holder of claim 6 wherein said support member is of one piece and is comprised of a plastic material.

8. The variable length sign holder of claim 1 wherein said base further comprises a living hinge located between said sleeve and said plate.

9. A variable length sign holder comprising:

a base comprising:

a sleeve including a first end, a second end and a socket extending from said first end toward said second end, a plate to which said second end of said sleeve is secured, and a pair of enlarged openings located on said sleeve exterior periphery, said pair of enlarged openings being longitudinally spaced along said sleeve and communicating with said socket;

a support member comprising:

a shaft slidably mounted in said socket of said sleeve, said shaft having a first end, a second end and an outer periphery, a lug located on said shaft outer periphery, said lug cooperating with one of said pair of enlarged openings, and a relieved area located in said shaft adjacent said lug; and a flexing means for allowing said sleeve to expand and accommodate a sliding movement of the shaft in the sleeve, said flexing means being located on said sleeve.

10. The variable length sign holder of claim 9 wherein said base further comprises a stub extending away from said plate and wherein said stub and said sleeve extend from opposite faces of said plate.

11. The variable length sign holder of claim 10 wherein a pair of spaced stubs extend away from said plate, each of said stubs being adapted for insertion into a respective hole of an associated pegboard.

12. The variable length sign holder of claim 9 wherein said base further comprises a living hinge located between said sleeve and said plate.

13. The variable length sign holder of claim 9 wherein said pair of enlarged openings are longitudinally spaced along said slot and communicate therewith.

14. The variable length sign holder of claim 9 wherein said support member further comprises a face channel located on said second end of said shaft, and wherein said support member is of one piece and is comprised of a plastic material.

15. A variable length sign holder comprising:

a base comprising:

a sleeve including a first end, a second end and a socket extending from said first end toward said second end, and a plate to which said second end of said sleeve is secured; and, a support member comprising a shaft slidably mounted in said socket of said sleeve, said shaft having a first end, a second end and an outer periphery;

flexing means for allowing said sleeve to expand and accommodate a sliding movement of said shaft in said sleeve, said flexing means being located on said sleeve; and, locking means for securing said shaft at a predetermined location along a length of said sleeve, said locking means being located on at least one of said base and said support member.

16. The variable length sign holder of claim 15 wherein said base further comprises a stub extending away from said plate and wherein said stub and said sleeve extend in opposed directions from said plate.

17. The variable length sign holder of claim 15 wherein said locking means comprises:

a pair of enlarged openings located on an exterior periphery of said sleeve, said pair of enlarged openings being longitudinally spaced along said sleeve; and, a lug located on said outer periphery of said shaft, said lug cooperating with one of said enlarged openings.

18. The variable length sign holder of claim 17 further comprising a biasing means for urging said lug outwardly of said shaft.

19. The variable length sign holder of claim 18 wherein said shaft comprises a resilient material and said biasing means comprises a relieved area located in said shaft, said relieved area being aligned with said lug and being spaced therefrom.

20. The variable length sign holder of claim 15 wherein said flexing means comprises a slot extending longitudinally along an exterior periphery of said sleeve and communicating with said socket.

* * * * *